US010769892B2

(12) United States Patent
Abrahamson

(10) Patent No.: US 10,769,892 B2
(45) Date of Patent: Sep. 8, 2020

(54) WHEEL BONUS SYSTEM FOR TABLE GAMES

(71) Applicant: AGS LLC, Las Vegas, NV (US)

(72) Inventor: Jamie Abrahamson, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 185 days.

(21) Appl. No.: 15/936,400

(22) Filed: Mar. 26, 2018

(65) Prior Publication Data

US 2019/0043314 A1 Feb. 7, 2019

Related U.S. Application Data

(60) Provisional application No. 62/539,576, filed on Aug. 1, 2017.

(51) Int. Cl.
*G07F 17/32* (2006.01)
*A63F 3/00* (2006.01)
(Continued)

(52) U.S. Cl.
CPC ..... *G07F 17/3267* (2013.01); *A63F 1/00* (2013.01); *A63F 3/00157* (2013.01); *A63F 5/02* (2013.01);
(Continued)

(58) Field of Classification Search
CPC ..... G07F 17/3213; G07F 17/3244; G07F 17/3211; G07F 17/3297; G07F 17/34; A63F 2003/00164; A63F 3/00157; A63F 5/02
See application file for complete search history.

(56) References Cited

U.S. PATENT DOCUMENTS 5,292,127 A 3/1994 Kelly et al.
5,318,298 A 6/1994 Kelly et al.
(Continued)

FOREIGN PATENT DOCUMENTS

AU 708104 10/1997
AU 2002314959 12/2002

OTHER PUBLICATIONS

Australian Patent Office; Written Opinion of the ISA for International Application No. PCT/US2018/044431, dated Oct. 5, 2018, in 8 pages.
(Continued)

*Primary Examiner* — William H McCulloch, Jr.
(74) *Attorney, Agent, or Firm* — Weide & Miller, Ltd.

(57) ABSTRACT

A bonus providing element distinct from underlying game play enables individual player unique benefits to an underlying game winning outcome by the bonus providing element providing a linear indication of at least three individual random indicators including:

a) an identification of a single one of at least two different player positions;
b) at least one of an absolute amount or multiplier of a winning outcome payout; and
c) at least one of a multiplier, prize or an absolute amount larger than or smaller than any absolute amount or multiplier in b).

When a winning outcome or triggering outcome by a first player position (any player position in a group of players) occurs in an underlying game, the bonus providing element is subsequently activated to randomly provide random outcomes for each of the at least three individual random indicators.

26 Claims, 6 Drawing Sheets

(51) Int. Cl.
*A63F 1/00* (2006.01)
*A63F 5/02* (2006.01)

(52) U.S. Cl.
CPC ..... *G07F 17/3276* (2013.01); *G07F 17/3288* (2013.01); *G07F 17/3293* (2013.01); *A63F 2001/001* (2013.01); *A63F 2001/003* (2013.01); *A63F 2001/005* (2013.01); *A63F 2003/0017* (2013.01); *A63F 2003/00164* (2013.01); *G07F 17/3258* (2013.01)

(56) References Cited

U.S. PATENT DOCUMENTS 5,409,225 A 4/1995 Kelly et al.
5,584,763 A 12/1996 Kelly et al.
5,700,007 A 12/1997 Kelly et al.
5,707,285 A 1/1998 Place et al.
5,722,891 A 3/1998 Inoue
5,743,523 A 4/1998 Kelly et al.
5,788,573 A 8/1998 Baerlocher et al.
5,848,932 A 12/1998 Adams
5,967,514 A 10/1999 Kelly et al.
6,089,978 A 7/2000 Adams
6,244,595 B1 6/2001 Kelly et al.
6,334,814 B1 1/2002 Adams
6,446,964 B1 9/2002 Kelly et al.
6,491,296 B2 12/2002 Kelly et al.
6,533,273 B2 3/2003 Cole et al.
6,612,574 B1 9/2003 Cole et al.
6,612,575 B1 9/2003 Cole et al.
6,663,488 B1 12/2003 Adams
6,676,517 B2 * 1/2004 Beavers ..... G06Q 50/34 463/25
6,692,355 B2 * 2/2004 Baerlocher ..... G07F 17/32 273/143 R
6,705,944 B2 * 3/2004 Luciano ..... G07F 17/32 273/143 R
6,827,646 B2 12/2004 Adams
7,011,581 B2 3/2006 Cole et al.
7,100,916 B2 9/2006 Kelly et al.
7,235,011 B2 * 6/2007 Randall ..... G07F 17/32 463/25
7,278,635 B2 10/2007 Kelly et al.
7,311,598 B2 12/2007 Kaminkow et al.
7,322,886 B2 1/2008 Manz
7,618,316 B2 * 11/2009 Cole ..... G07F 17/3223 463/13
7,651,394 B2 * 1/2010 Johnson ..... G07F 17/32 463/20
7,931,532 B2 4/2011 Johnson
7,963,847 B2 * 6/2011 Baerlocher ..... G07F 17/32 463/16
8,021,230 B2 * 9/2011 Baerlocher ..... G07F 17/32 463/16
8,221,214 B2 * 7/2012 Nicely ..... G07F 17/32 463/20
8,342,941 B2 * 1/2013 Nicely ..... G07F 17/32 463/20
8,360,844 B2 * 1/2013 Schwartz ..... G07F 17/3211 463/17
8,460,082 B2 * 6/2013 Harris ..... G07F 17/34 463/16
8,932,125 B1 1/2015 Harris
8,956,213 B2 * 2/2015 Manz ..... G07F 17/3244 463/19
9,111,414 B1 * 8/2015 Sirois ..... G07F 17/3297
9,292,996 B2 * 3/2016 Davis ..... G07F 17/32
9,401,064 B2 * 7/2016 Young ..... G07F 17/3213
9,662,563 B2 * 5/2017 Van Asdale ..... A63F 9/24
9,972,169 B2 * 5/2018 Davis ..... G07F 17/32
9,997,013 B2 * 6/2018 Litman ..... A63F 1/00
10,204,486 B2 * 2/2019 Van Asdale ..... A63F 9/24
10,311,681 B2 * 6/2019 Litman ..... G07F 17/3293
2002/0042294 A1 * 4/2002 Pau ..... G07F 17/3262 463/16
2003/0100361 A1 5/2003 Sharpless et al.
2005/0059471 A1 3/2005 Cannon
2005/0119039 A1 * 6/2005 Berman ..... G07F 17/3293 463/16
2005/0119042 A1 6/2005 Chamberlain et al.
2006/0009278 A1 1/2006 Vancura
2006/0033268 A1 2/2006 Wong
2006/0082057 A1 4/2006 Luciano et al.
2007/0054723 A1 * 3/2007 Mattice ..... G07F 17/3211 463/16
2007/0060239 A1 3/2007 Nelson
2007/0072668 A1 * 3/2007 Hein ..... G07F 17/323 463/16
2007/0117608 A1 5/2007 Roper et al.
2007/0135204 A1 * 6/2007 Nicely ..... G07F 17/3267 463/17
2008/0128986 A1 * 6/2008 Morris ..... A63F 5/02 273/142 E
2008/0146309 A1 6/2008 Bennett
2009/0075715 A1 3/2009 Coleman et al.
2011/0059789 A1 3/2011 Luciano
2012/0122545 A1 5/2012 Watkins et al.
2012/0142410 A1 6/2012 Olive et al.
2012/0322546 A1 * 12/2012 Lalumiere ..... G07F 17/3272 463/26
2013/0029758 A1 * 1/2013 Berman ..... G07F 17/34 463/25
2013/0143640 A1 * 6/2013 Young ..... G07F 17/3211 463/20
2014/0113712 A1 * 4/2014 Van Asdale ..... G07F 17/3258 463/27
2014/0378205 A1 12/2014 Montenegro et al.
2015/0170460 A1 * 6/2015 Marais ..... G07F 17/34 463/20
2015/0258425 A1 * 9/2015 Fisher ..... A63F 5/0088 273/142 E
2015/0265913 A1 * 9/2015 Fisher ..... A63F 5/0088 273/142 E
2016/0125689 A1 * 5/2016 Hoffman ..... G07F 17/3223 463/20
2016/0155296 A1 * 6/2016 Baron ..... G07F 17/322 463/25
2019/0043314 A1 * 2/2019 Abrahamson ..... G07F 17/3276

OTHER PUBLICATIONS

Australian Patent Office; Notification of Transmittal of the ISR and Written Opinion of the ISR for International Application No. PCT/US2018/0444341, dated Oct. 5, 2018, in 8 pages.

* cited by examiner

① ② ③ ④ ⑤ ⑥ ⑦

* Circles can be color coded

* Illuminated when player participates

FIG.4

62 70

| | | | | | | | | | |
|---|---|---|---|---|---|---|---|---|---|
| Community prize | $500 | $25 | $250 | $15 | $500 | $40 | $75 | $750 | ←64 |
| Player position | 3 | 5 | 1 | 6 | 2 | 4 | 8 | 7 | ←66 |
| Enhanced prize | 5x | 2x | JACKPOT | 10x | $5000 | 3x | 25x | 2x | ←68 |

←60

WHEEL BONUS SYSTEM FOR TABLE GAMES

BACKGROUND OF THE INVENTION

1. Field of the Invention

The present invention relates to the field of casino table games and bonus outcomes on the casino table games when predetermined event outcomes occur in an underlying casino table game.

2. Background of the Art

Many different systems and configuration have been attempted to provide bonus events in casino table gaming systems. Each of these have their benefits and detractions. For example, AGS, Las Vegas, Nev. acquired a virtual bonus spin wheel from Aristocrat Gaming that is a single wheel with a single bonus event indicator on it, like a simple candy wheel, that can be spun after a player has a winning outcome. It is used to benefit a single pre-identified player after a winning event has occurred.

SUMMARY OF THE INVENTION

A bonus providing element (BPE) is distinct from underlying game play. The BPE enables individual players unique benefits to an underlying game when winning outcomes or triggering outcomes occur. The bonus providing element provides a linear indication (linear may be a radial line) of at least three individual random indicators (which may be within frames), the three individual random indicators including:

a) an identification of a single one of at least two different player positions;

b) at least one of an absolute amount or multiplier of a winning outcome payout; and c) at least one of a multiplier, prize or an absolute amount larger than or smaller than any absolute amount or multiplier in b).

When a winning outcome or triggering outcome by a first player position (any player position in a group of players) occurs in an underlying game, the bonus providing element is subsequently activated to randomly provide random outcomes for each of the at least three individual random indicators, and the random outcomes for the three individual random indicators is applied as i) one random outcome for the first player position, and ii) a combination of two remaining random outcomes indicates an award to at least one player position different from the first player position.

BRIEF DESCRIPTION OF THE FIGURES

FIG. 4 shows a frontal view of a first physical (or virtual) three row, six column random event outcome system.

DETAILED DESCRIPTION OF THE INVENTION

Figure 1:
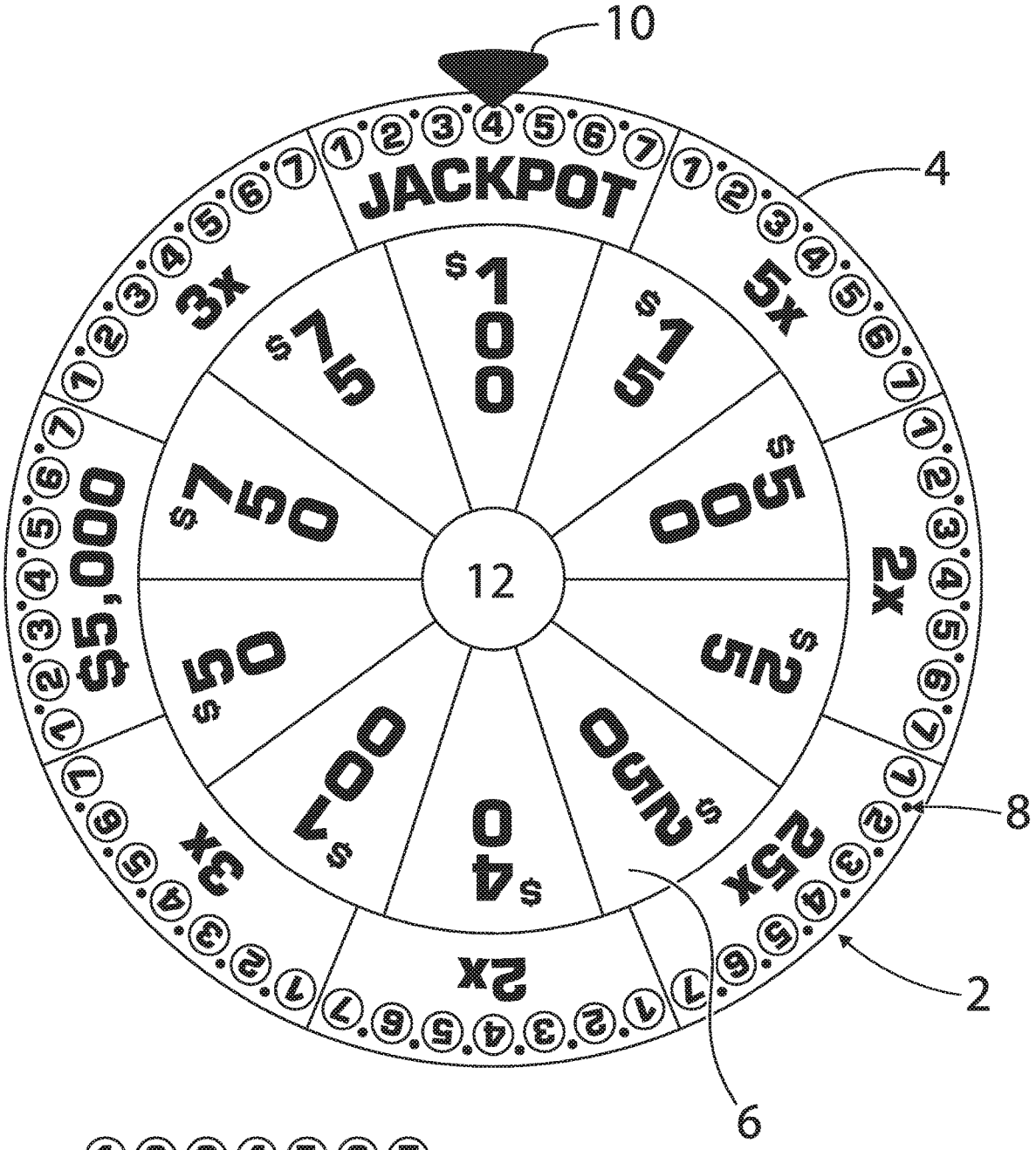
FIG. 1 shows a frontal view of a physical (or virtual) two concentric spinning wheel system.

A bonus providing element (BPE) is distinct from underlying game play. The BPE enables individual player unique benefits to an underlying game winning outcome. The device may be electronic (e.g., with multiple player positions around a table or arena or viewing screen) or physical and describable as including a bonus providing element distinct from underlying game play that enables individual players or groups of players unique benefits to the underlying game winning outcome or triggering outcome by the bonus providing element providing a linear indication of at least three individual random indicators, the at least three individual random indicators including:

a) an identification of a single one of at least two different player positions;

b) at least one of an absolute amount or multiplier of a winning outcome payout; and c) at least one of a multiplier, prize or an absolute amount larger than or smaller than any absolute amount or multiplier in b).

When a winning outcome or triggering outcome by a first player position (any player position in a group of players) occurs in an underlying game, the bonus providing element is subsequently activated to randomly provide random outcomes for each of the at least three individual random indicators, and the random outcomes for the three individual random indicators is applied as i) one random outcome for the first player position, and ii) a combination of two remaining random outcomes indicates an award to at least one player position different from the first player position.

In the bonus providing element, linear indication may be provided by at least three distinct and randomly rotating concentric elements with a first rotating concentric element defining a sector of a first concentric circular wheel indicating one of a), b) and c), and a second rotating concentric element defining a sector of a second rotating concentric wheel one of a), b) and c) without repeating any one of a), b) and c), and a third rotating concentric element defining a sector of a third rotating concentric wheel one of a), b) and c) without repeating any one of a), b) and c).

The bonus providing element may have linear indication provided by at least two distinct and randomly rotating concentric elements with an inner element defining a sector of a circular wheel indicating one or two of a), b) and c), and at least one outer element defining a truncated sector at least one of a), b) and c) without repeating any one of a), b) and c) defined by inner element, with a total of exactly three of a), b) and c) provided by the inner element and the at least one outer element.

The bonus providing element may have linear indication provided by three distinct and randomly rotating concentric elements with an inner element defining a sector of a circular wheel indicating one of a), b) and c), and a first outer element defining a truncated sector with one of a), b) and c) without repeating any of a), b) and c) defined by the inner element; and a second outer element defining a truncated sector with one of a), b) and c) without repeating any of a), b) and c) defined by the inner element and the first outer element with a total of exactly three of a), b) and c) provided by the inner element, the first outer element and the second outer element.

The bonus providing elements may have the inner element provide exactly one of a), b) and c), and the outer element provide remaining ones of a), b) and c) not provided for in the inner element, or the outer element provide exactly one of a), b) and c), and the inner element provide remaining ones of a), b) and c) not provided for in the inner element.

The bonus providing element may have the bonus providing element providing a linear indication of at least three individual random indicators comprising three rows of at least six columns, all random outcomes for a), b) and c) distributed with all combinations of one of a), b) and c) distributed within respective ones of a top row, middle row and bottom row, and the linear indication comprising a single column.

The bonus providing element may alternatively have the bonus providing element providing a linear indication of at least three individual random indicators comprising six rows of at least three columns, all random outcomes for a), b) and c) distributed with all combinations of one of a), b) and c) distributed within respective ones of a left column, middle column and right column, and the linear indication comprising a single row.

The bonus providing elements may be provided by physical elements including a rotating inner sector and rotating outer truncated sectors, or by virtual elements comprising a rotating inner sector and rotating outer truncated sectors provided on a video display in communication with a processor, memory and a random number generator, the random number generator providing random ones of a), b) and c) for display on the video display.

The bonus providing element in a virtual display may have random outcomes provided by virtually horizontally shifting columns on the video display or provided by virtually vertically shifting columns on the video display.

The bonus providing elements may be associated with a single a casino table configured for use with a physical playing card game, dice game, or wheel game (e.g., roulette or Big Six), multiple linked tables, an arena set up of multiple player positions, a multiplayer platform with individual players sharing a common screen or dealer and the like. The bonus providing element may be associated with a single casino table configured for use with a physical playing card game, dice game, or wheel game. The virtual or physical playing card game, dice game, or wheel game may be selected from the group consisting of blackjack, baccarat, poker, craps, sic bo, and roulette.

The wheel system is a progressive/side bet bonus system for table games. In one embodiment, all players must place a separate wager before the table game begins to participate. The system is triggered by a specific event that occurs during the underlying game. In this embodiment, the trigger is a community event (eg. Boxcars in craps, a 0 or 00 in roulette, trips in Sic Bo, a dealer 3 card seven in Baccarat). The wheel system contains 3 randomly generated events. In one version, the first event is a community prize that all participating players win. The second event is a player position at the table. The third event is an enhanced prize (either a multiplier of the community prize, a fixed dollar amount, a physical prize (car), or a progressive jackpot) which the player position selected in the second event wins. The selected player position must be participating in the bonus wager to receive the prize. The system may reveal the three randomly generated events in any order. In another embodiment, the trigger is an event unique to at least one participating player (eg. A dealt blackjack in Blackjack, a flush in Pai Gow). The wheel system contains 3 randomly generated events. The first event is a prize that the at least one participating player with the triggered event wins. The second event is a player position at the table. The third event is an Envy prize which the player position selected in the second event wins (the third event may be a percentage of the prize selected in the first event, or an absolute amount). The selected player position must be participating in the bonus wager to receive the prize. The system may reveal the three randomly generated events in any order.

The Wheel Bonus System is for all formats and all table games—Live, ETG, Virtual, Online, Mobile.

A common problem with community games is that all combinations of cards, dice and roulette results that trigger a progressive jackpot do so for all of the participating players, and the players have to share the progressive.

A method for providing bonus events to an underlying gaming event including multiple players at identified player positions may be performed by:

at least one player placing a wager in the underlying gaming event;

executing an event to conclusion of an outcome of the underlying gaming event;

identifying the outcome as a predefined triggering outcome;

after identifying the outcome as the predefined triggering outcome, activating a bonus providing element distinct from underlying game play to enable individual players or groups of players unique benefits in the underlying game triggering outcome, the bonus providing element providing a linear indication of at least three individual random indicators, the three individual random indicators including:

a) an identification of a single one of at least two different player positions;

b) outcomes of at least one of an absolute amount or multiplier of a winning outcome payout; and c) outcomes of at least one of a multiplier, prize or an absolute amount larger than or smaller than any absolute amount or multiplier in b);

wherein, in combination with the triggering outcome by a first player position in the underlying game, the bonus providing element randomly provides random outcomes for each of the three individual random indicators, and the random outcomes for the three individual random indicators is applied as i) one random outcome for at least the first player position, and ii) a combination of two remaining random outcomes indicates an award to at least one player position that may be different from the first player position.

The method may have the bonus events available to only players wagering a predetermined minimum amount on the underlying game or available to only players wagering a side bet or progressive wager.

In one embodiment of the method, a single one of at least five different player positions may be awarded only one of a), b) or c), and at least one of at least four remaining player positions in the underlying game are awarded a fixed award different from the only one of a), b) and c) awarded to the single one of the at least five player positions.

The underlying game may be a playing wagering event executed on a physical gaming table, and the bonus providing event comprises a separate physical random event generator or electronic random generator comprising the three individual random indicators. The method may be executed wherein b) and c) are each unequally weighted among frequencies of b) and c) outcomes and a) is equally weighted among individual different player position frequencies.

The three randomly generated events can be displayed in several different formats.

Figure 2:
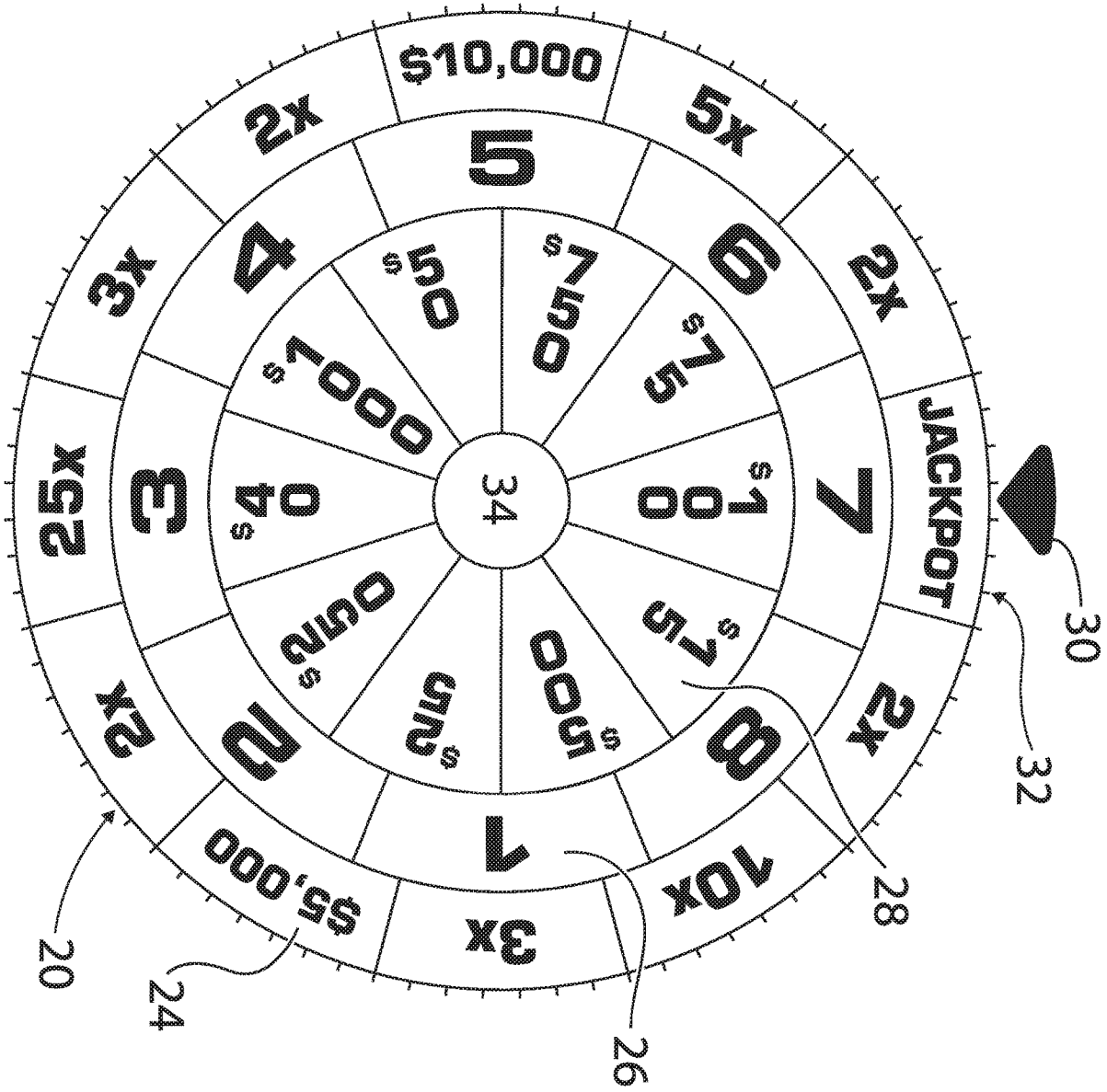
FIG. 2 shows a frontal view of a first physical (or virtual) three concentric spinning wheel system.
Figure 3:
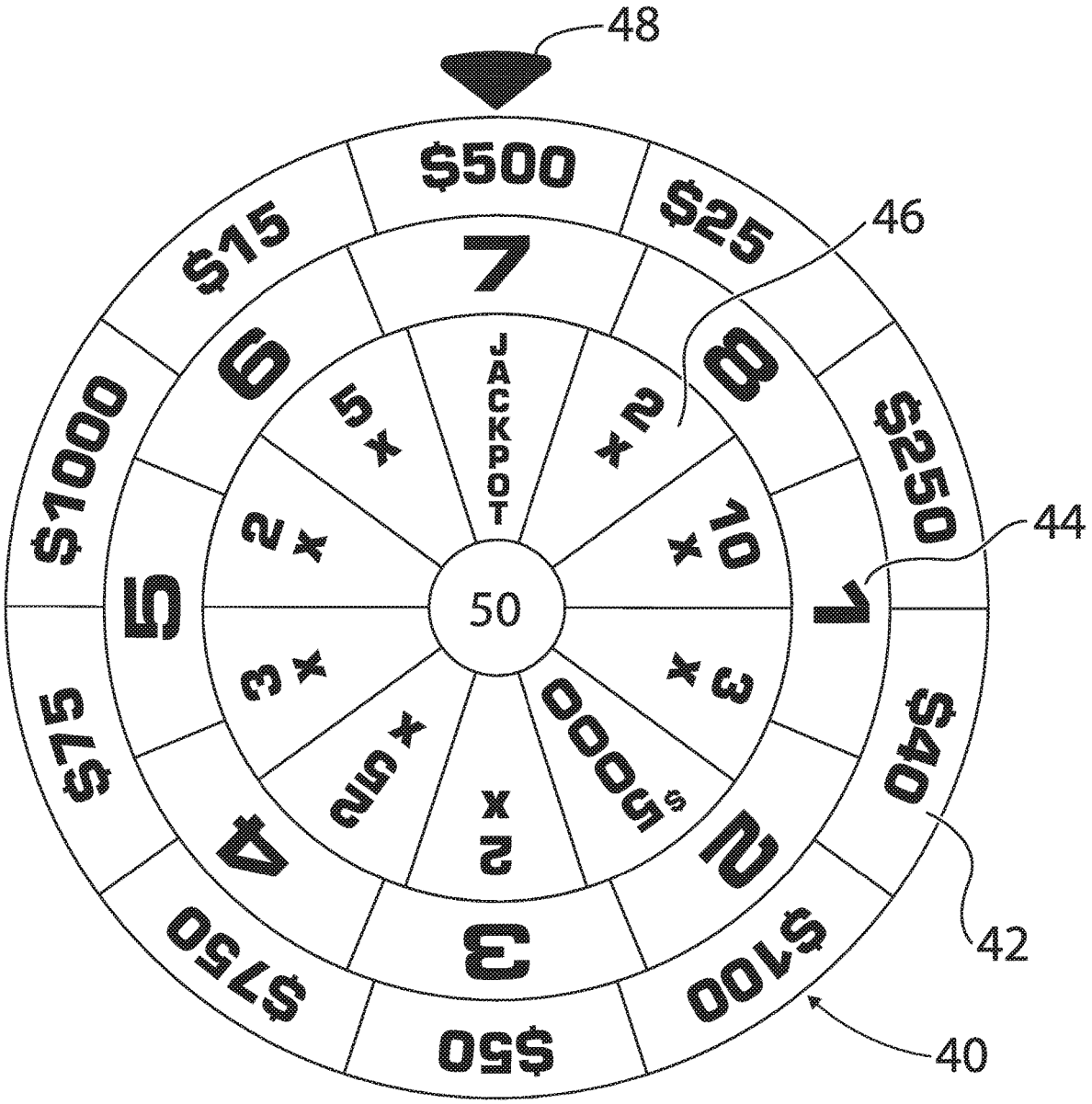
FIG. 3 shows a frontal view of a second physical (or virtual) three concentric spinning wheel system.

One embodiment uses a wheel with three rings (FIGS. 2 and 3). One ring of the wheel determines the community prize won or an individual player position won. A $2^{nd}$ ring determines a player position. This 2nd ring can have a number of sections which equals the number of player positions at the table OR can have a number of sections which equals the number of participating players at the table. A $3^{rd}$ ring determines what the enhanced prize is (either a multiplier of the community prize, a fixed dollar amount, a physical prize (car), or a progressive jackpot). The wheel may display the three rings in any order (SEE FIG. 3).

Another embodiment uses a wheel with two rings. One ring of the wheel determines the community prize won. The second ring determines a player position AND an enhanced prize (either a multiplier of the community prize, a fixed dollar amount, a physical prize (car), or a progressive jackpot). This second ring can be displayed in two ways. The second ring can have a number of sections which display the enhanced prizes. Each of these sections can be divided into different sectors to determine which player position wins the enhanced prize (FIG. 1). The size of the sections can be proportionate to the likelihood of winning the enhanced prize (Example . . . a sector for a 2× multiplier can be larger than the jackpot sector, indicating it is more likely under the secondary RNG). However the section sizes can also be the same size, with some sections being more likely than others. In another embodiment the second ring can have a number of sections which display the player positions. Each of these sections can be divided into different sectors to determine the enhanced prize.

Another embodiment uses 3 individual wheels—each wheel displaying one of the three randomly generated events.

FIG. 1 shows a frontal view of a physical (or virtual) two concentric spinning wheel system 2. The system 2 is shown with an outer truncated sector 4 having both divider pegs 8 which separate each of the numbers player position identifiers (here, 1, 2, 3, 4, 5, 6, and 7 players are identified). Here a physical (or virtual) pointer 10 identifies a random selection of Player 4 on the outer wheel 4 and the absolute value award of $100.00 in the center sector of inner wheel 6. There is a virtual or physical center axis 12 shown, with the regions 4 and 6 revolving around that center axis 12.

FIG. 2 shows a frontal view of a first physical (or virtual) three concentric spinning wheel system 20. An outermost first truncated sector wheel 24 is shown (this is "truncated" as the innermost portion of the sector is cut away or covered by inner wheel elements 26 and 28) with multipliers and absolute award amounts (including a "Jackpot") that are higher than any absolute award amounts in the inner sector element 28, which is in turn within the second truncated sector area 26 which randomly identifies player positions (here randomly selected from among 1, 2, 3, 4, 5, 6, 7 and 8 player positions). A virtual or physical pointer 30 stops relative to virtual or physical pegs 32 to identify the three linear random bonus selector outcomes in the three areas 24, 26 and 28). The three linear random bonus selector outcomes in the three areas 24, 26 and 28 are concentric to a physical or virtual center axis 34.

FIG. 3 shows a frontal view of a second physical (or virtual) three concentric spinning wheel system 40. Again, a virtual or physical pointer 48 and center axis 50 are shown. The three areas of outer truncated sector 42, inner truncated sector 44 and inner sector 46 are shown indicating their respective individual ones of the three random elements that combine to implement the bonus. For example, when there is a suited blackjack, two naturals in baccarat, or at least a flush in a stud poker table game, the spinning wheel system 40 may be activated, and the award given (for example) whether or not the identified player position is the position triggering the event (all positions in baccarat trigger the event as there is a common players' hand) to that identified player position.

FIG. 4 shows a frontal view of a first physical (or virtual) three row 64, 66, 68, six column 70 random event outcome system 60. A virtual or physical pointer 62 identifies the three random indicators to be combined. The rows 64, 66, 68 would shift back and forth to create randomness, either physically or virtually.

Figure 5:
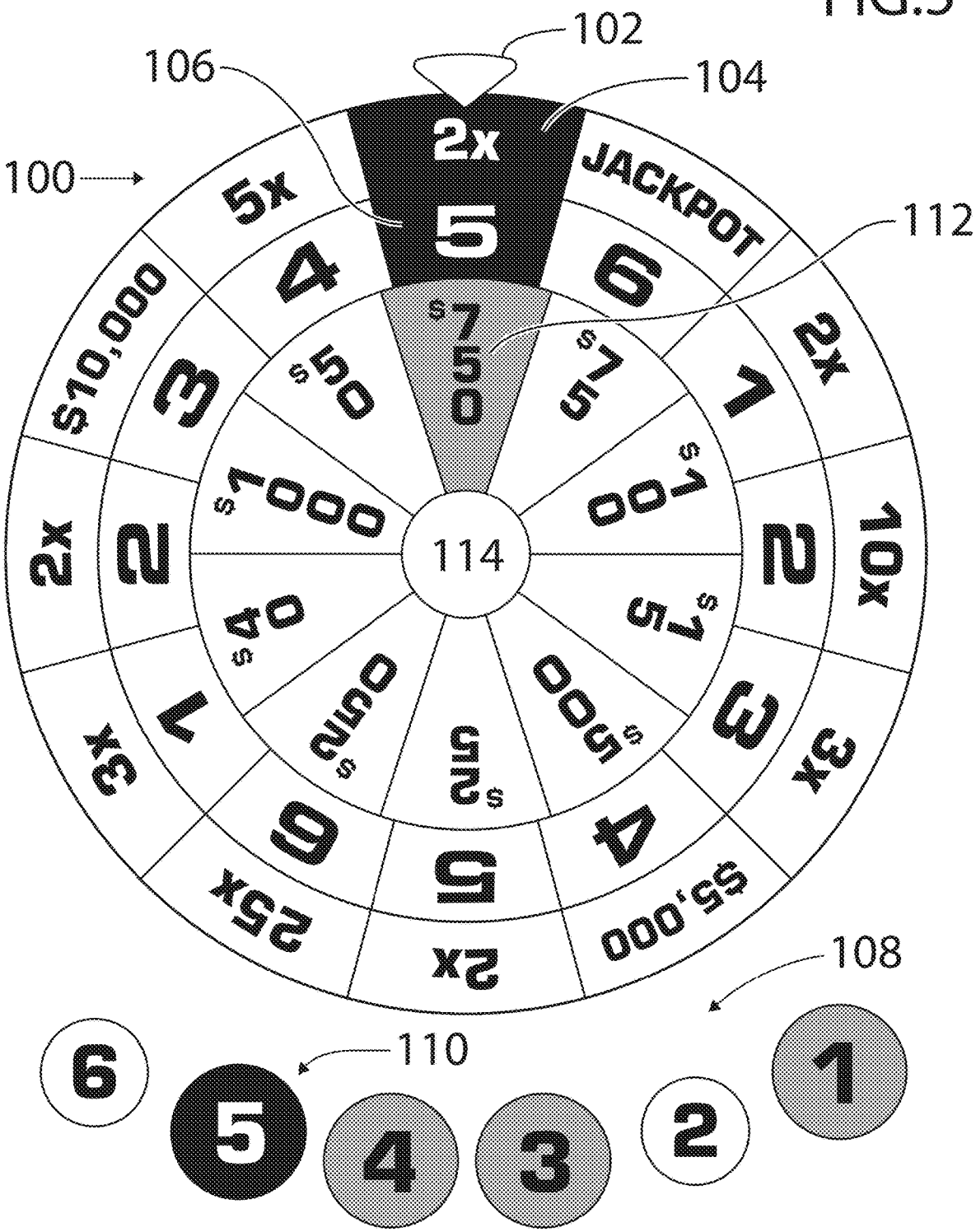
FIG. 5 shows a frontal view of a first physical (or virtual) three concentric wheel, six player column random event outcome system.

FIG. 5 shows a frontal view of a first physical (or virtual) three concentric wheel device 100, six player column random event outcome system. A pointer 102 is shown conveniently located at a top position with respect to the wheel device 100. The pointer 102 is pointing down three aligned segments 104 (showing a 2× award), a second segment 106 indicating a player position (from among 1, 2, 3, 4, 5, and 6 shown on the concentric wheel device 100) that is awarded the 2× random award of the first segment 104. The third center segment 112 (the order of the random effects is optional) indicates an award of $750 for all participating players that had the winning outcome or the triggering event for the bonus activity provided by the three concentric wheel device 100. A central spindle area 114 is shown, as well as a separate display area 108 in which the player position (110 No. 5) selected by the second segment 106 is highlighted.

Figure 6:
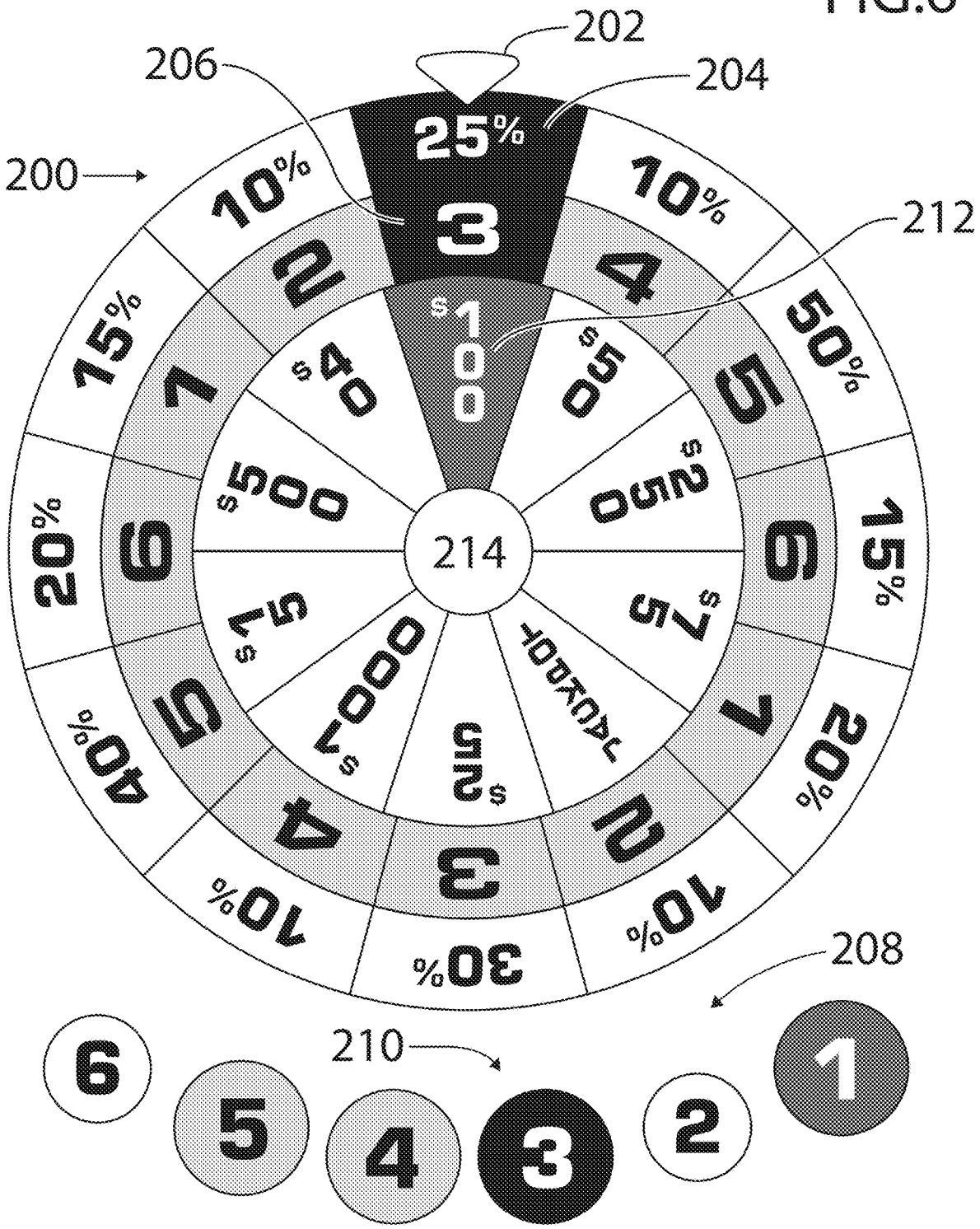
FIG. 6 shows a frontal view of a second physical (or virtual) three concentric wheel, six player column random event outcome system.

FIG. 6 shows a frontal view of a second physical (or virtual) three concentric wheel 200, six player column random event outcome system. A pointer 202 is shown conveniently located at a top position with respect to the wheel device 200. The pointer 202 is pointing down three aligned segments 204 (showing a 25% award multiplied against any objective, such as the minimum wager, the amount won by a player triggering the bonus event, or a multiple of the minimum wager, etc.), a second segment 206 indicating a player position (from among 1, 2, 3, 4, 5, and 6 shown on the concentric wheel device 200) that is awarded the 25% random award of the first segment 204. The third center segment 212 (the order of the random effects is optional) indicates an award of $100 for a player that had the winning outcome or the triggering event for the bonus activity provided by the three concentric wheel device 200. A central spindle area 214 is shown, as well as a separate display area 208 in which the player position (210 No. 3) selected by the second segment 206 is highlighted.

To enhance security at casinos, more and more table games, bonus events and secondary games use electronic wagering systems, such as player input controls, video display screens and a processor with memory configured to store and receive credit, and debit and credit accrual in credit. The gaming system may operate as an electronic device (table, console, bank of games machines, etc.). Each table and/or each player position may have a value-in-value-out component selected from the group consisting of a currency validator with a currency scanner and currency-advancing motor, a ticket-in-ticket-out reader and printer combination, a magnetic or bar code reader accessible through an input opening, and an electronic wallet near-field communication reader.

The electronic alternative of this technology may be provided by components similar to or identical to a standard EGM, with software and display images in memory that can implement a reproduction or duplication of the operation of a physical device.

Other options are within the scope of the invention such as automated highlighting of individual random outcomes on the bonus device, and the like.

What is claimed:

1. A bonus providing element distinct from underlying game play that enables individual players or groups of players unique benefits to an underlying game winning outcome or triggering outcome by the bonus providing element providing a linear indication of at least three individual random indicators, the three individual random indicators comprising:

a) an identification of a single one of at least two different player positions;

b) at least one of an absolute amount or multiplier of a winning outcome payout; and c) at least one of a multiplier, prize or an absolute amount larger than or smaller than any absolute amount or multiplier in b);

wherein, in combination with a winning outcome or triggering outcome by a first player position in an underlying game, the bonus providing element subsequently activated to randomly provide random outcomes for each of the three individual random indicators, and the random outcomes for the three individual random indicators is applied as i) one random outcome for the first player position, and ii) a combination of two remaining random outcomes indicates an award to at least one player position different from the first player position.

2. The bonus providing element of claim 1 wherein linear indication is provided by at least three distinct and randomly rotating concentric elements with a first rotating concentric element defining a sector of a first concentric circular wheel indicating one of a), b) and c), and a second rotating concentric element defining a sector of a second rotating concentric wheel one of a), b) and c) without repeating any one of a), b) and c), and a third rotating concentric element defining a sector of a third rotating concentric wheel one of a), b) and c) without repeating any one of a), b) and c).

3. The bonus providing element of claim 2 wherein an inner element provides exactly one of a), b) and c), and outer elements provide remaining ones of a), b) and c) not provided for in the inner element.

4. The bonus providing element of claim 2 wherein the outer element provides exactly one of a), b) and c), and the inner element provides remaining ones of a), b) and c) not provided for in the outer element.

5. The bonus providing element of claim 1 wherein linear indication is provided by three distinct and randomly rotating concentric elements with an inner element defining a sector of a circular wheel indicating one of a), b) and c), and a first outer element defining a truncated sector with one of a), b) and c) without repeating any of a), b) and c) defined by the inner element; and a second outer element defining a truncated sector with one of a), b) and c) without repeating any of a), b) and c) defined by the inner element and the first outer element with a total of exactly three of a), b) and c) provided by the inner element, the first outer element and the second outer element.

6. The bonus providing element of claim 1 wherein the bonus providing element providing a linear indication of at least three individual random indicators comprises three rows of at least six columns, all random outcomes for a), b) and c) distributed with all combinations of one of a), b) and c) distributed within respective ones of a top row, middle row and bottom row, and the linear indication comprising a single column.

7. The bonus providing element of claim 6 wherein random outcomes are provided by virtually horizontally shifting columns on the video display.

8. The bonus providing element of claim 1 wherein the bonus providing element providing a linear indication of at least three individual random indicators comprises six rows of at least three columns, all random outcomes for a), b) and c) distributed with all combinations of one of a), b) and c) distributed within respective ones of a left column, middle column and right column, and the linear indication comprising a single row.

9. The bonus providing element of claim 8 wherein random outcomes are provided by virtually vertically shifting columns on the video display.

10. The bonus providing element of claim 1 which is provided by physical annular elements comprising a rotating inner sector and rotating outer truncated sectors.

11. The bonus providing element of claim 1 which is provided by virtual elements comprising a virtual rotating inner sector and virtual rotating outer truncated sectors provided on a video display in communication with a processor, memory and a random number generator, the random number generator providing random ones of a), b) and c) for display on the video display.

12. The bonus providing element of claim 1 associated with a single casino game table configured for use with a physical playing card game, a physical dice table game or a physical roulette wheel ball-drop-and-capture table.

13. The bonus providing element of claim 1 associated with a single casino game table configured for use with a physical playing card game.

14. The bonus providing element of claim 13 wherein the physical playing card game is selected from the group consisting of blackjack, baccarat and poker.

15. The bonus providing element of claim 1 wherein the bonus providing element has an a), b) or c) that is able to distinguish between at least 5 different player positions.

16. The method of claim 15 wherein the bonus events are available to only players wagering a side bet or progressive wager.

17. The bonus providing element of claim 1 wherein the one random outcome for the first player position comprises the at least one of an absolute amount or multiplier of a winning outcome payout in b) and said award to said at least one player position different from the first player position comprises the combination of b) and c).

18. The bonus providing element of claim 1 wherein said at least one player position different from the first player position comprises a player that qualified for a bonus.

19. The bonus providing element of claim 1 further comprising at least one first indicator indicting said first player position and a second indicator indicating said at least one player position different from the first position.

20. A method for providing bonus events to an underlying gaming event including multiple players at identified player positions comprising:

at least one player placing a wager in the underlying gaming event;

executing an event to conclusion of an outcome of the underlying gaming event;

identifying the outcome as a predefined triggering outcome;

after identifying the outcome as the predefined triggering outcome, activating a bonus providing element distinct from underlying game play to enable individual players or groups of players unique benefits in the underlying game triggering outcome, the bonus providing element providing a linear indication of at least three individual random indicators, the three individual random indicators comprising:

a) an identification of a single one of at least two different player positions;

b) outcomes of at least one of an absolute amount or multiplier of a winning outcome payout; and c) outcomes of at least one of a multiplier, prize or an absolute amount larger than or smaller than any absolute amount or multiplier in b);

wherein, in combination with the triggering outcome by a first player position in the underlying game, the bonus providing element randomly provides random outcomes for each of the three individual random indicators, and the random outcomes for the three individual random indicators is applied as i) one random outcome for at least the first player position, and ii) a combination of two remaining random outcomes indicates an award to at least one player position that may be different from the first player position.

21. The method of claim 20 wherein the bonus events are available to only players wagering a predetermined minimum amount on the underlying game.

22. The method of claim 20 wherein a single one of at least five different player positions is awarded only one of a), b) or c), and at least one of at least four remaining player positions in the underlying game are awarded a fixed award different from the only one of a), b) and c) awarded to the single one of the at least five player positions.

23. The method of claim 20 wherein the underlying game is a playing wagering event executed on a physical gaming table, and the bonus providing event comprises a separate physical random event generator or electronic random generator comprising the three individual random indicators.

24. The method of claim 20 wherein b) and c) are each unequally weighted among frequencies of b) and c) outcomes and a) is equally weighted among individual different player position frequencies.

25. A bonus providing element distinct from underlying game play for indicating a first award to qualifying players from said underlying game play and a second award to a selected one of said qualifying players, comprising:

a) a first concentric circular wheel comprising a plurality of sectors, each sector identifying a single one of said qualifying players;

b) a second concentric circular wheel comprising a plurality of sectors, each sector identifying a first award comprising at least one of an absolute amount or multiplier of a winning outcome payout; and c) a third concentric circular wheel comprising a plurality of sectors, each sector identifying at least one of a multiplier, prize or an absolute amount larger or smaller than said first award;

wherein said first, second and third concentric wheels are rotated and one of said plurality of sectors of said first concentric wheel is selected to identify said single one of said qualifying players, one of said plurality of sectors of said second concentric wheel is selected to identify said first award to said qualifying players, and one of said plurality of sectors of said third concentric wheel is selected, wherein said second award comprises a combination of said first award and said at least one of a multiplier, prize or absolute amount of indicated by said selected sector of said third concentric wheel.

26. The bonus providing element of claim 25 further comprising:

d) a first indicator indicating player positions comprising said qualifying players; and e) a second indicator of said identified single one of said qualifying players.

* * * * *